US007967466B2

(12) United States Patent
Chu

(10) Patent No.: US 7,967,466 B2
(45) Date of Patent: Jun. 28, 2011

(54) MOVABLE LIGHT BAR ASSEMBLY

(75) Inventor: Ko-Chien Chu, Hsien (TW)

(73) Assignee: System Photovoltaic Science Co., Ltd., Taoyuan Hsien (TW)

( * ) Notice: Subject to any disclaimer, the term of this patent is extended or adjusted under 35 U.S.C. 154(b) by 68 days.

(21) Appl. No.: 12/471,661

(22) Filed: May 26, 2009

(65) Prior Publication Data

US 2010/0302763 A1 Dec. 2, 2010

(51) Int. Cl.
*F21L 4/08* (2006.01)
*F21L 4/00* (2006.01)

(52) U.S. Cl. ..... 362/183; 362/217.02; 362/221; 362/197; 362/224; 362/217.15

(58) Field of Classification Search ..... 362/183, 362/224, 217.15, 217.16, 217.01, 221, 197
See application file for complete search history.

(56) References Cited

U.S. PATENT DOCUMENTS

| | | | | |
|---|---|---|---|---|
| 6,139,164 | A * | 10/2000 | Bolta et al. | 362/217.1 |
| 6,840,657 | B2 * | 1/2005 | Tung | 362/352 |
| 7,731,386 | B2 * | 6/2010 | Levine | 362/197 |
| 2010/0232147 | A1 * | 9/2010 | Bryant et al. | 362/183 |

* cited by examiner

*Primary Examiner* — Anabel M Ton
(74) *Attorney, Agent, or Firm* — Pro-Techter Int'l Services; Ralph Willgohs

(57) ABSTRACT

A movable light bar assembly includes a primary frame having a side coupled with a secondary frame and an opposite side coupled with at least one lighting element and a battery element. The secondary frame has a surface provided with solar chips and is provided internally with a photoelectric transducer electrically connected to the battery element and the at least one lighting element. Each lighting element is provided with at least one light-emitting body and secured to the primary frame by a lamp cover. The battery element is secured to the primary frame by a battery cover. The primary frame is peripherally provided with at least one rotatable handle which, when angularly offset from the primary frame, serves to support the primary frame. The at least one handle is insertable into a fixing base and connectable with a hanging cord. The primary frame can be positioned at a lamp frame.

8 Claims, 15 Drawing Sheets

MOVABLE LIGHT BAR ASSEMBLY

BACKGROUND OF THE INVENTION

1. Technical Field

The present invention relates to lighting devices and, more particularly, to a movable light bar assembly having a solar module.

2. Description of Related Art

Of all sources of energy, electricity is the most convenient in transmission. As electric appliances become more and more popular, and computers take on an indispensable role in our daily lives, the consumption of electricity, which is derived mainly from wind power, hydraulic power, or by burning petroleum, natural gas, or garbage, has increased significantly in amount as well as in duration, and yet energy resources of these forms are exhaustible. On the other hand, solar energy is the most easily accessible and the least expensive of all natural energy sources and is inexhaustible on a sunny day. In order to utilize solar energy, a wide variety of solar lamps are now available that use silicon chips as an energy-capturing interface for converting light energy into electricity, wherein the currently applicable conversion rate is approximately 12% to 17%. Therefore, electric appliances such as street lamps, garden lamps, and certain household lighting devices that use a relatively small amount of electricity and are used only at night can be so configured as to capture solar energy during the day and store the captured solar energy for later use. While many solar lamps have been proposed in recent years, some of them are structurally integrated with existing lamps such that the resultant lamp assemblies suffer from low durability, despite the high luminosity obtained. In other designs where solar panels are installed separately from the lamps, the solar panels and the lamps are often difficult to build and esthetically incompatible with the surroundings; furthermore, each design has a unique configuration that allows little flexibility in assembly, let alone major modifications. In short, the conventional solar devices have limited applicability and adaptability. Hence, the inventor of the present invention conducted extensive research so as to develop a lighting device that not only meets practical needs but also overcomes the shortcomings of the conventional solar devices.

BRIEF SUMMARY OF THE INVENTION

The primary objective of the present invention is to provide a movable light bar assembly whose essential components together embody the concept of integration so as to adapt to different applications, particularly for illumination purposes. Besides, the light bar assembly has a bar-shaped body coupled with a special handle which not only enables portability but also serves as a stand such that the light bar assembly can be carried around and used as a movable lighting device. The handle can also be inserted in a fixing base. Moreover, the light bar assembly can be positioned at an outdoor lamp whose outer frames resemble a plurality of petals. In particular, the movable light bar assembly uses solar chips to obtain electricity, which is stored in a battery and then supplied to a lighting element of the light bar assembly or output from the battery through an output interface. In case of insufficient sunlight, the light bar assembly is chargeable by mains electricity through an input interface.

To achieve the aforesaid objective, the present invention provides a movable light bar assembly including a primary frame having a lateral side coupled with a secondary frame. The secondary frame has a surface provided with a plurality of solar chips and is internally provided with a photoelectric transducer. The primary frame has an opposite lateral side coupled with at least one lighting element and a battery element. The photoelectric transducer, the battery element, and the at least one lighting element are electrically connected. The lighting element is provided therein with at least one light-emitting body and is fixed in position to the primary frame by a lamp cover. The battery element is fixed in position to the primary frame by a battery cover. The primary frame has four peripheral edges which are provided with at least one handle fastened to the primary frame by a turning knob. The at least one handle, when rotated to be angularly offset from the primary frame, serves to support the primary frame. The at least one handle is also insertable into a slot of a fixing base and connectable with a hanging cord. In addition, the primary frame can be positioned at a lamp frame or a supporting seat of a lamp body whose outer configuration resembles multiple petals.

BRIEF DESCRIPTION OF THE SEVERAL VIEWS OF THE DRAWINGS

The technical means adopted by the present invention to achieve the above objective, as well as the advantages, features, and other objectives of the present invention, can be best understood by referring to the following detailed description of a preferred embodiment in conjunction with the accompanying drawings, wherein.

DETAILED DESCRIPTION OF THE INVENTION

Figure 1:
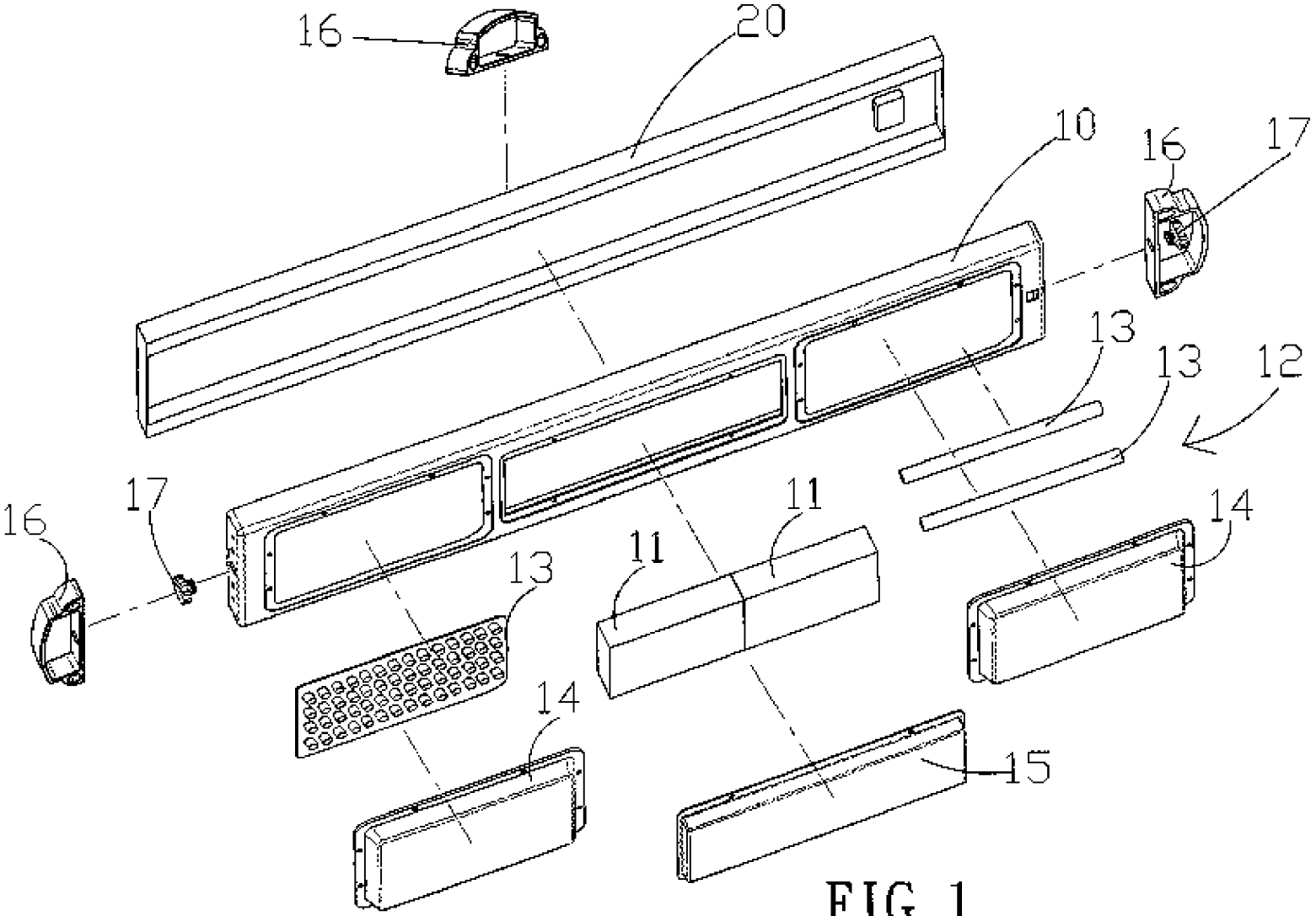
FIG. 1 is an exploded perspective view of a movable light bar assembly according to the present invention.
Figure 4:
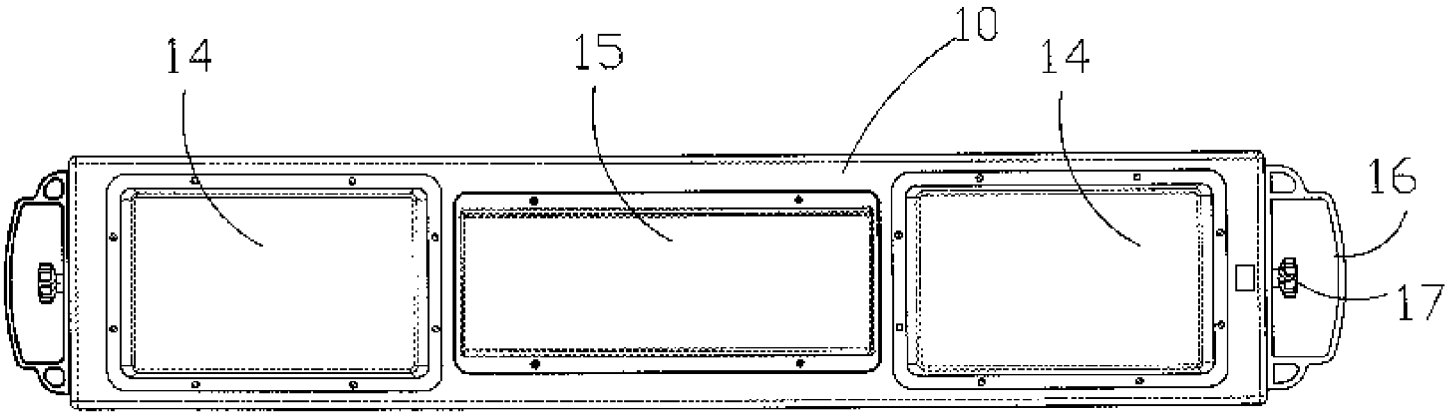
FIG. 4 is a front view of the movable light bar assembly according to the present invention.
Figure 3:
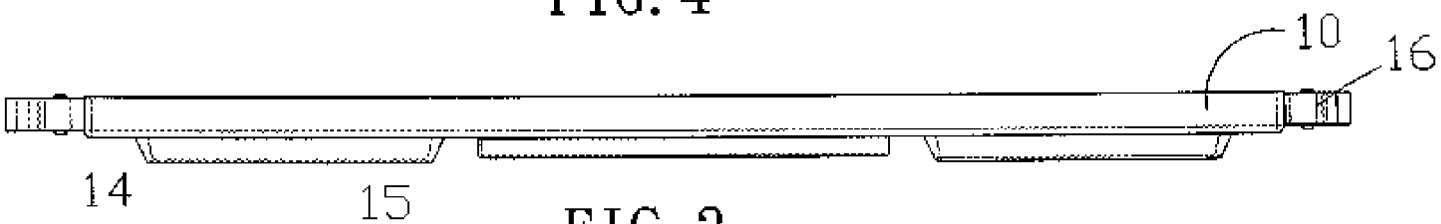
FIG. 3 is a top view of the movable light bar assembly according to the present invention.
Figure 2:
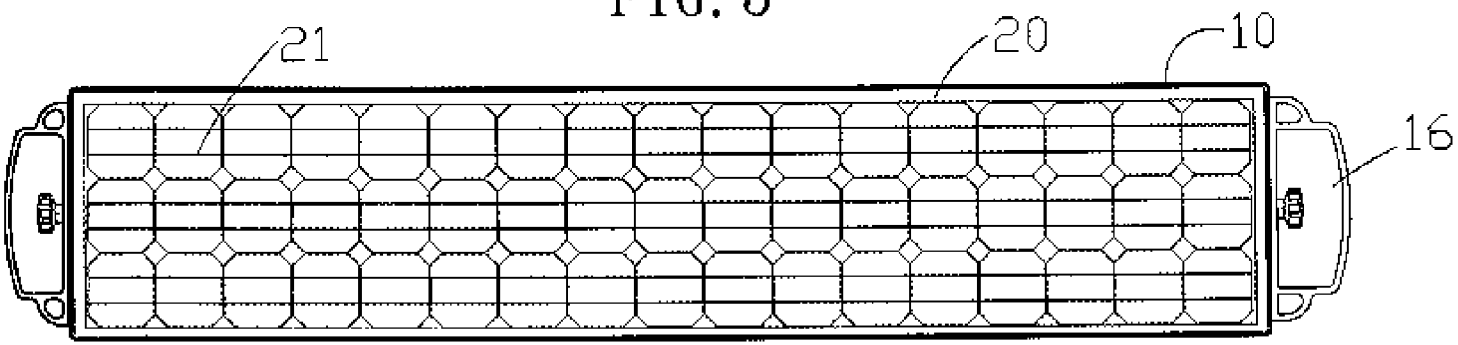
FIG. 2 is a rear view of the movable light bar assembly according to the present invention.
Figure 5:
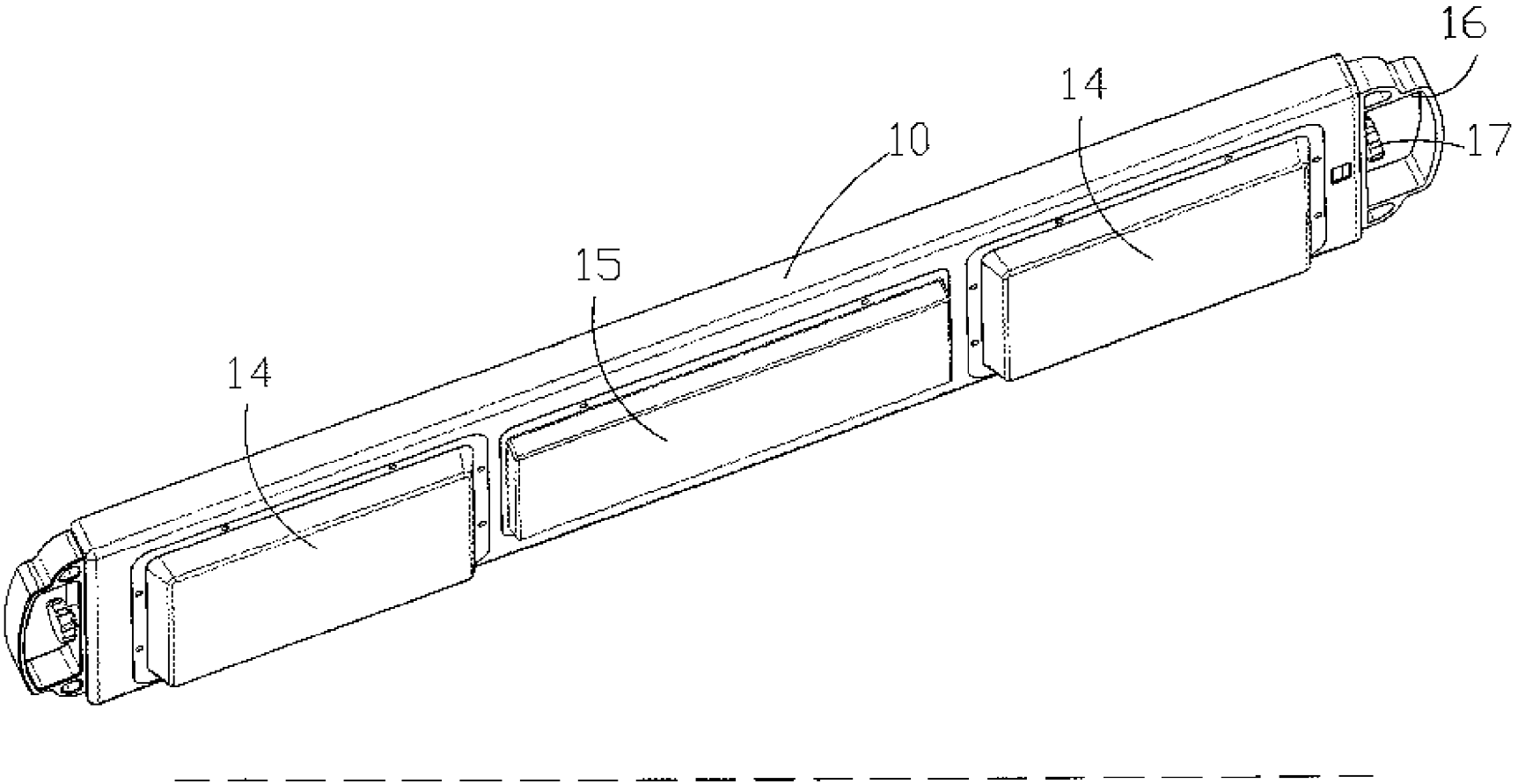
FIG. 5 is a perspective view of the movable light bar assembly according to the present invention.
Figure 6:
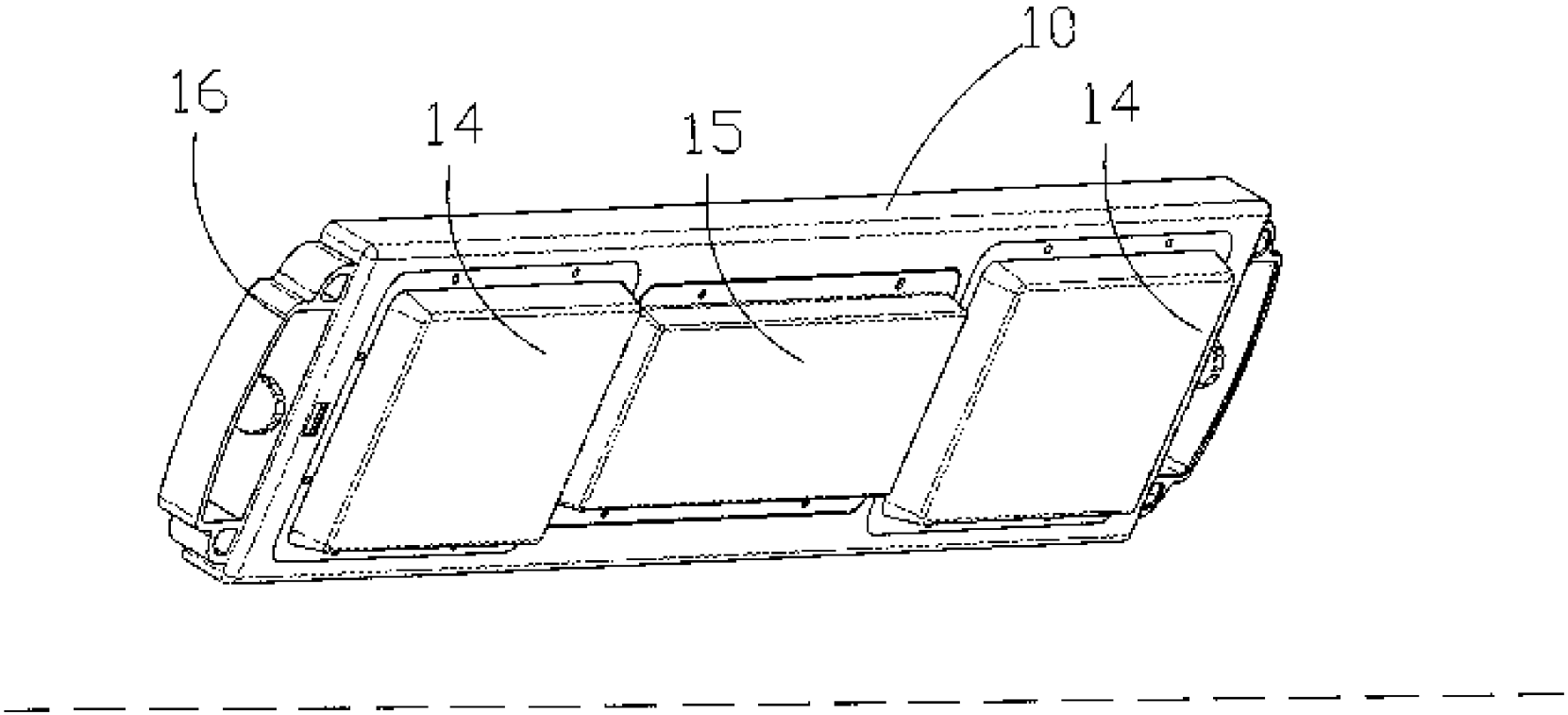
FIG. 6 is a perspective view of the movable light bar assembly according to the present invention, wherein the light bar assembly uses relatively wide lighting elements and is in a tilted state, with handles in their original positions.
Figure 7:
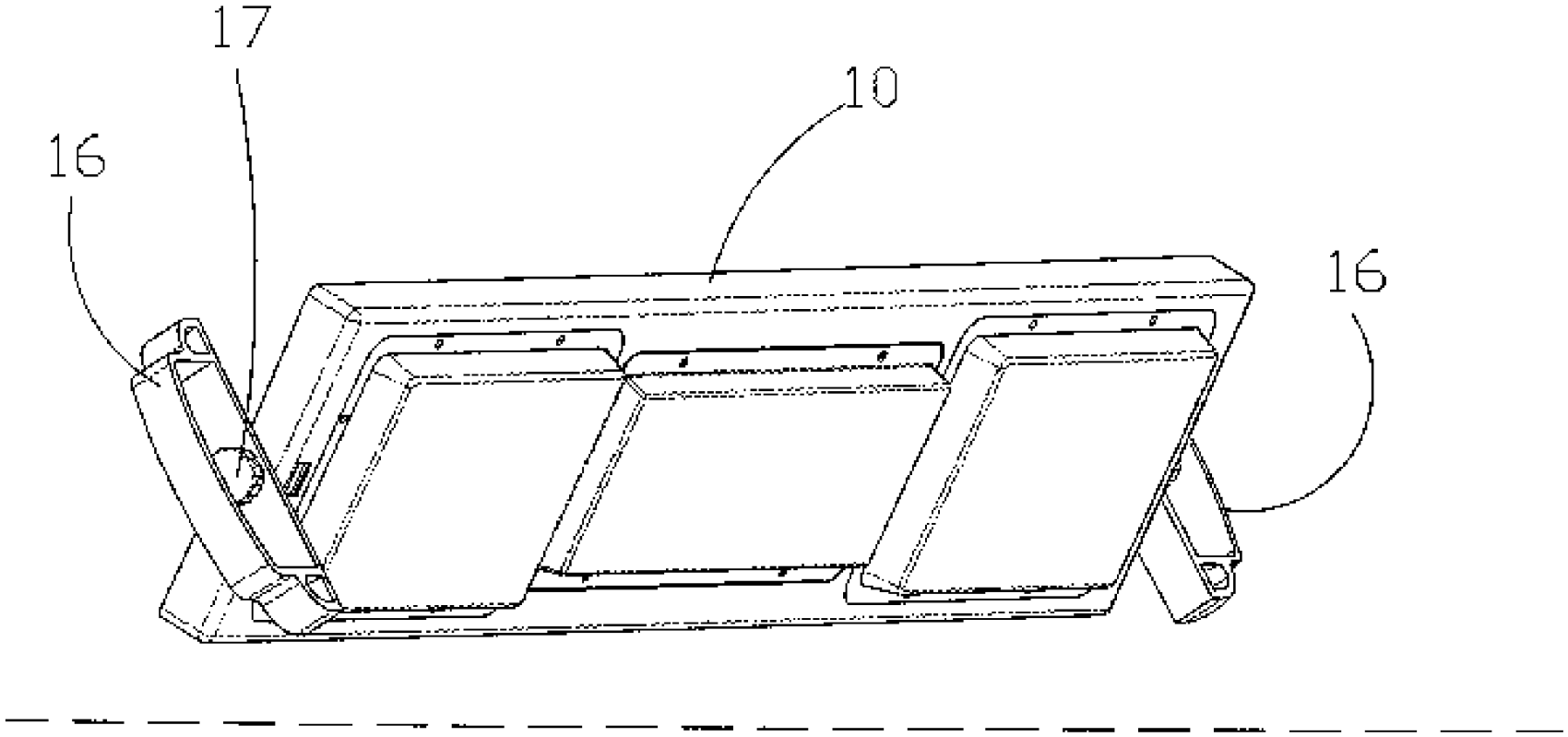
FIG. 7 is a perspective view of the movable light bar assembly shown in FIG. 6, supported in position by the handles.
Figure 8:
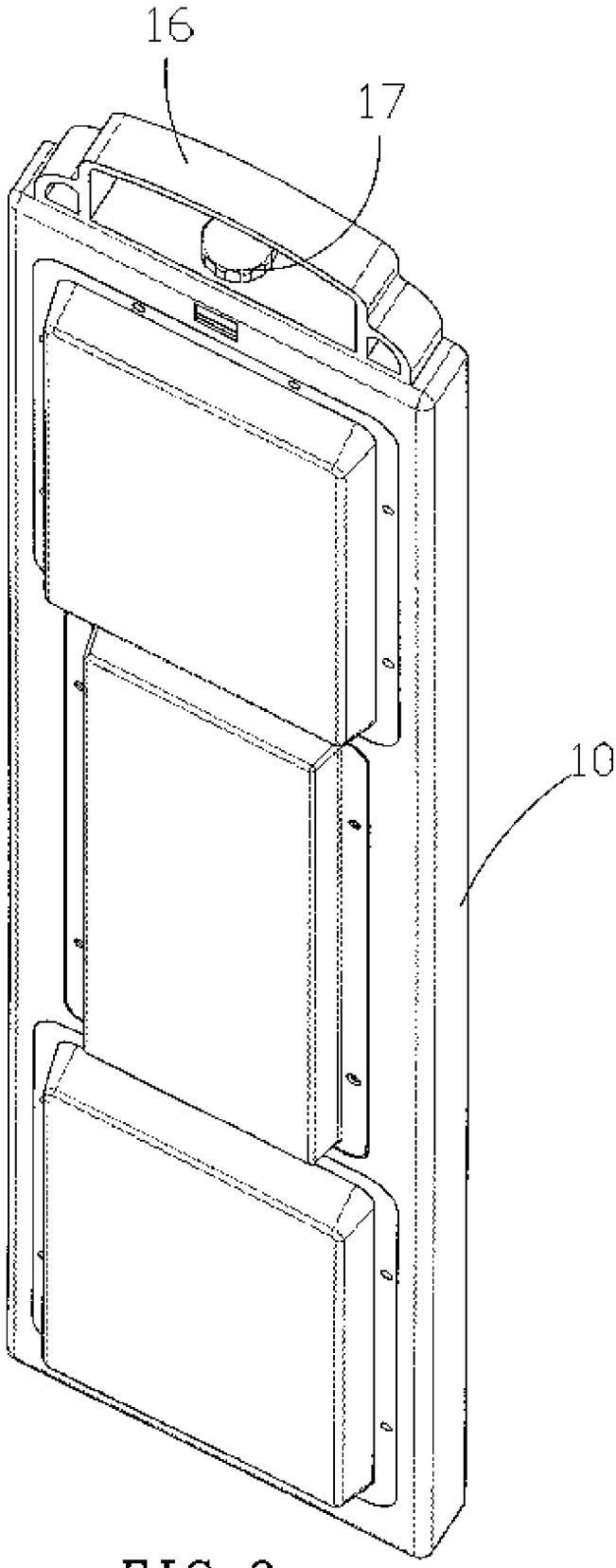
FIG. 8 is a perspective view of the movable light bar assembly shown in FIG. 6, wherein the light bar assembly is in an upright position and lacks the otherwise existing lower handle.
Figure 9:
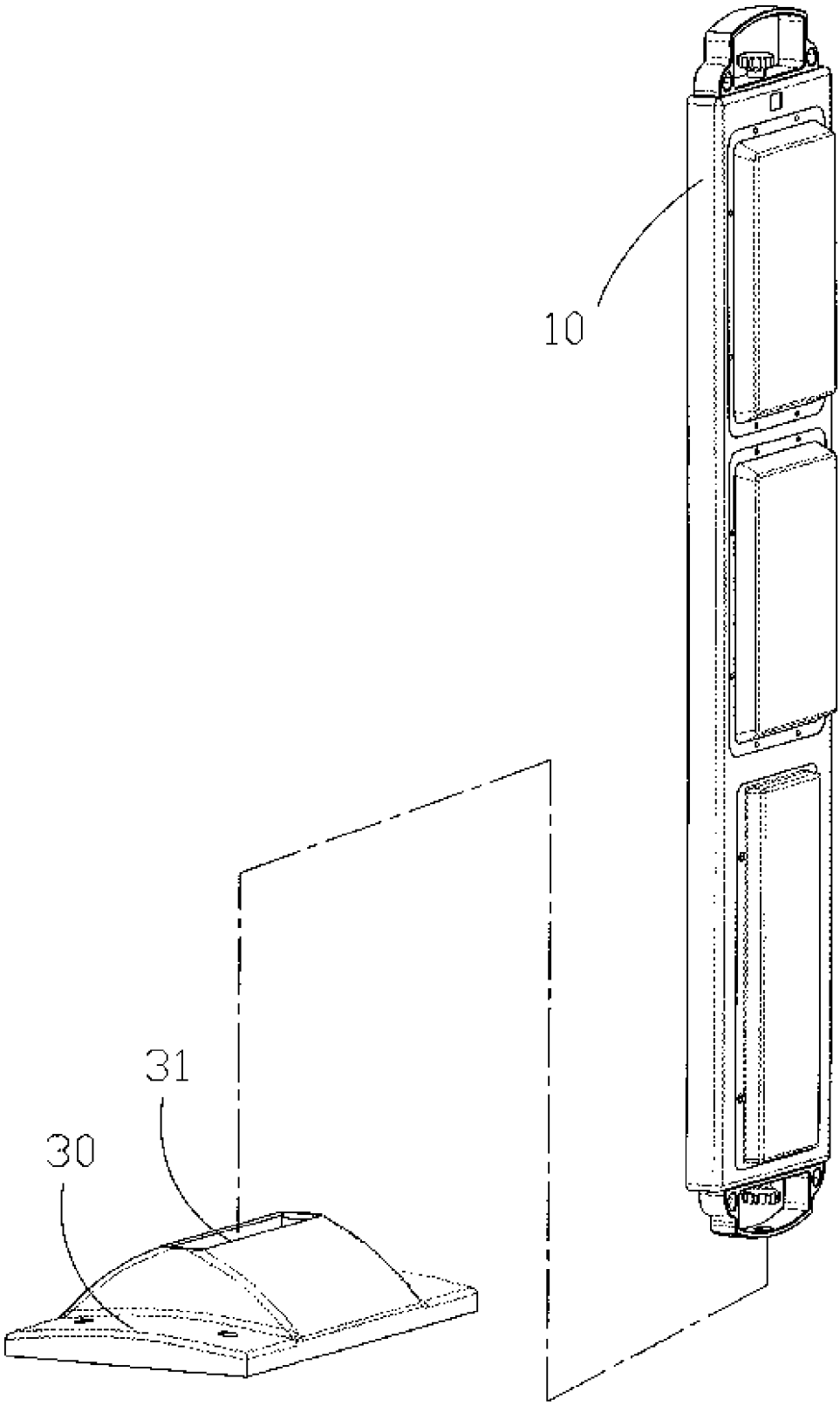
FIG. 9 is an exploded perspective view of the movable light bar assembly and a fixing base according to the present invention.
Figure 10:
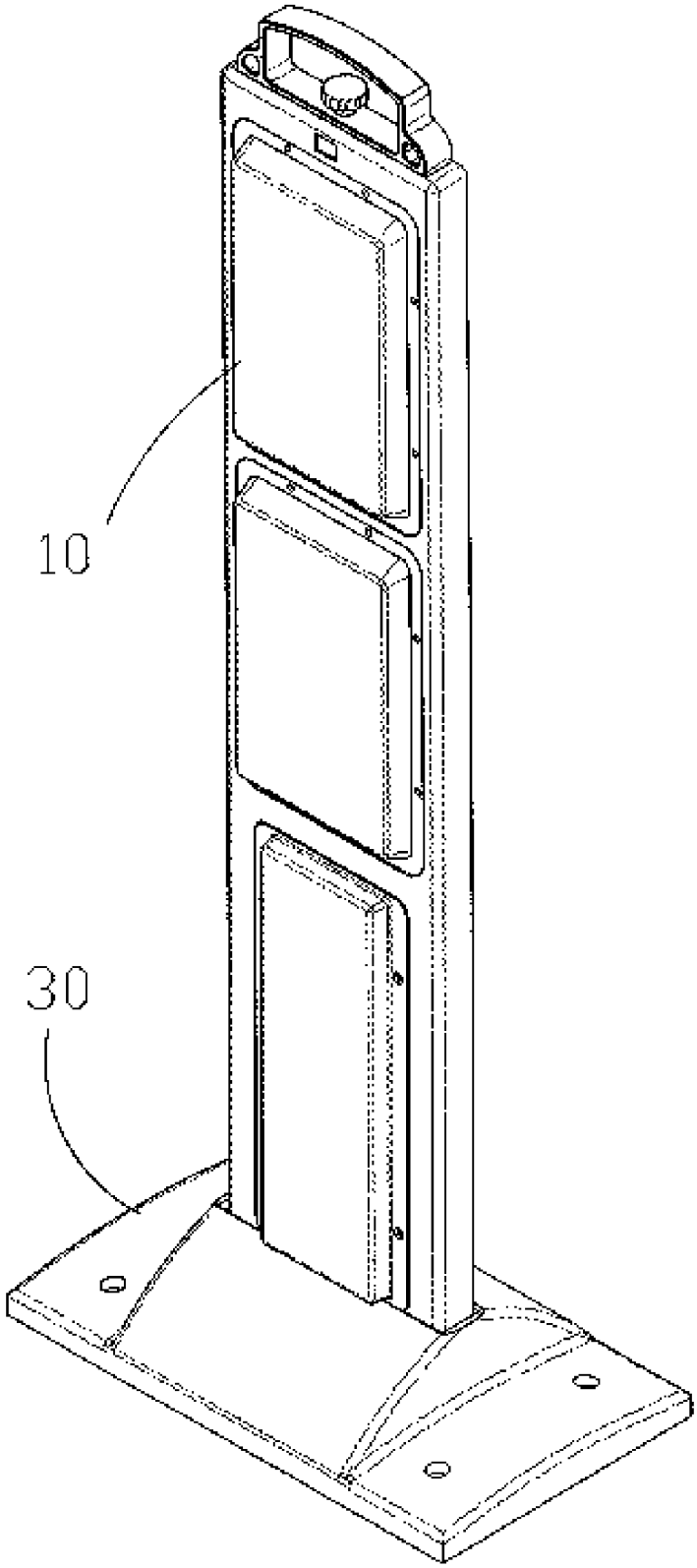
FIG. 10 is an assembled perspective view of the movable light bar assembly and the fixing base shown in FIG. 9.

FIGS. 1 through 17 illustrate a movable light bar assembly according to the present invention. As shown in FIGS. 1 through 8, which depict the basic structure of the present invention, the movable light bar assembly includes a primary frame 10 and a secondary frame 20 coupled to a lateral side of the primary frame 10. The secondary frame 20 has a surface provided with a plurality of solar chips 21, as shown more clearly in FIG. 2. A photoelectric transducer (not shown) is provided in the secondary frame 20 as an indispensable element of the light bar assembly. In addition, the light bar assembly must be equipped with a control circuit board (not shown) which may further include a photosensitive controller. The primary frame 10 has an opposite lateral side coupled with at least one lighting element 12 and a battery element 11 such that the photoelectric transducer, the battery element 11, and the at least one lighting element 12 are electrically connected. More specifically, electricity converted from solar energy by the photoelectric transducer is stored in the battery element 11 and then supplied therefrom to the lighting element 12. Each of the at least one lighting element 12 is provided therein with at least one light-emitting body 13 and is fixed in position to the primary frame 10 by a lamp cover 14. The at least one light-emitting body 13 is shown in the left part of FIG. 1 as light-emitting diodes, which are the mainstream light-emitting device nowadays, and in the right part of FIG. 1 as fluorescent tubes (T5 or T8). Alternatively, the at least one light-emitting body 13 may be a light bulb. The battery element 11 is secured in position to the primary frame 10 by a battery cover 15, which facilitates replacement of the battery element 11. At least one handle 16, having a hollow portion formed in an arch-shaped frame, is fastened at one or more of the four peripheral edges of the primary frame 10. (While the handles 16 in FIG. 1 are located at the left and right peripheral edges of the primary frame 10, the at least one handle 16 may also be provided at the upper and lower peripheral edges of the primary frame 10 as appropriate.) Each of the handles 16 is fastened to the primary frame 10 by a thumb screw 17. As shown in FIGS. 6 and 7, the handles 16 can be rotated and from positioned at an angle relative to the lateral side the primary frame 10 so as to support the primary frame 10 and adjust the sunlight-receiving angle or illumination angle of the light bar assembly. Alternatively, as shown in FIG. 8, the primary frame 10 has only one peripheral edge thereof provided with the handle 16 such that a user can grip the handle 16 and carry the light bar assembly around. In this case, the primary frame 10 can be positioned on the ground by placing any one of its peripheral edges on the ground (see also FIG. 5). Referring to FIGS. 9 and 10, the light bar assembly of the present invention further includes a fixing base 30 which has a top end formed with a slot 31. The handle 16 at one peripheral edge of the primary frame 10 (the lower peripheral edge in the drawings) is inserted into the slot 31 of the fixing base 30 such that the primary frame 10 stands with its longitudinal axis in a vertical or transverse direction.

Figure 11:
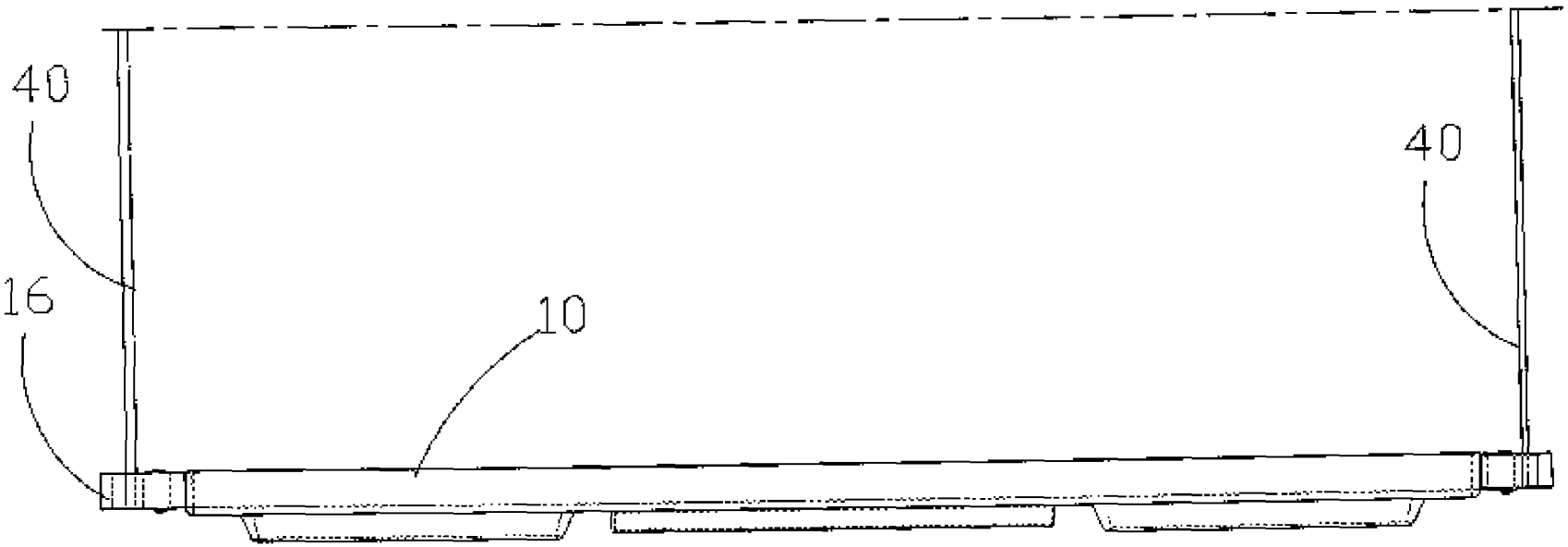
FIG. 11 is an assembled side view of the movable light bar assembly connected and a hanging cord according to the present invention.

Referring to FIG. 11, in one embodiment, the light bar assembly of the present invention has at least two handles 16, each provided on one of at least two peripheral edges of the primary frame 10. In this embodiment the light bar assembly further includes a hanging cord 40 whose two ends are each connected respectively with one of the handles 16. Thus, the primary frame 10 may be suspended on the hanging cord 40.

Figure 12:
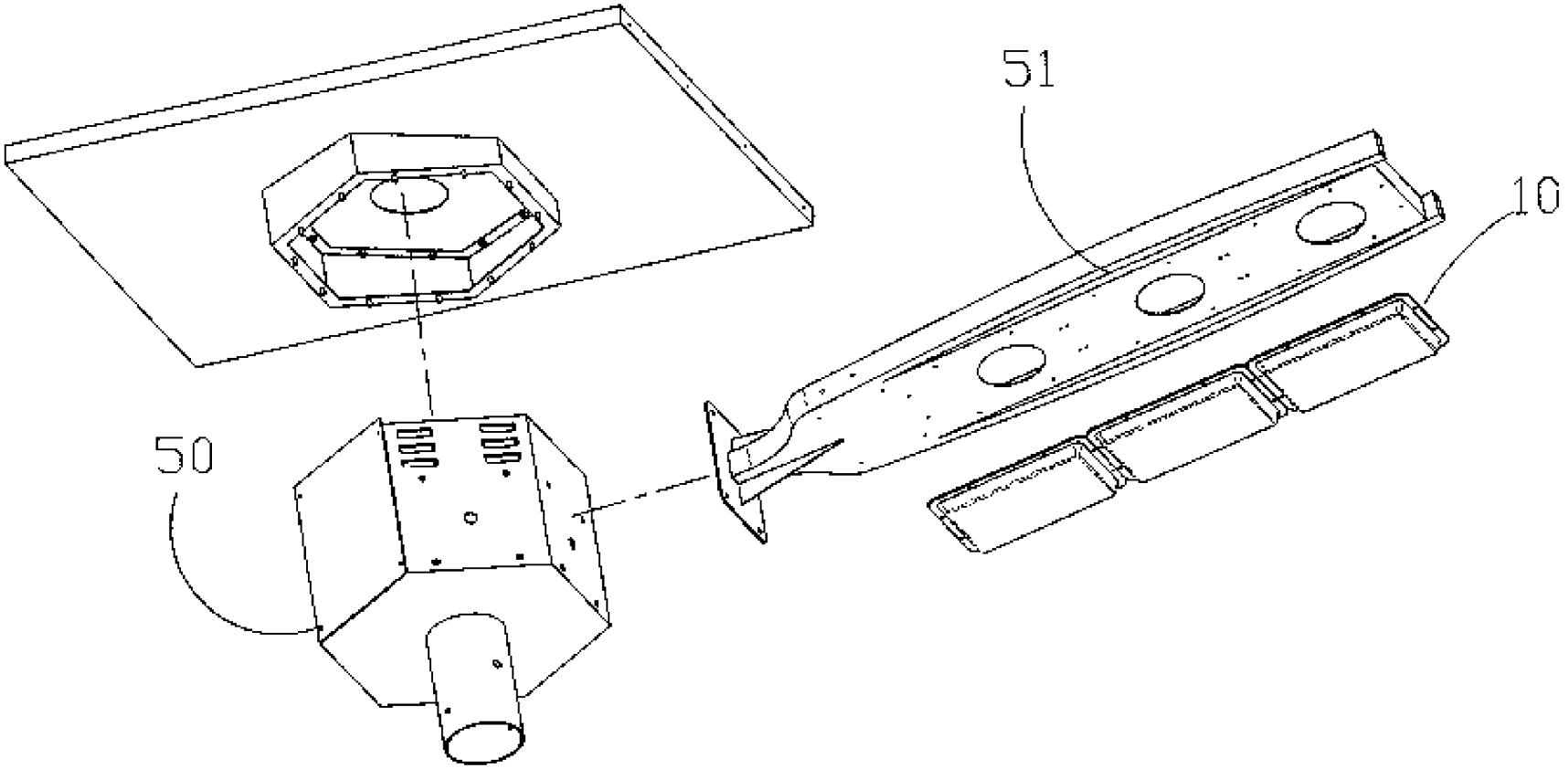
FIG. 12 is an exploded perspective view of the movable light bar assembly and a lamp body according to the present invention.
Figure 13:
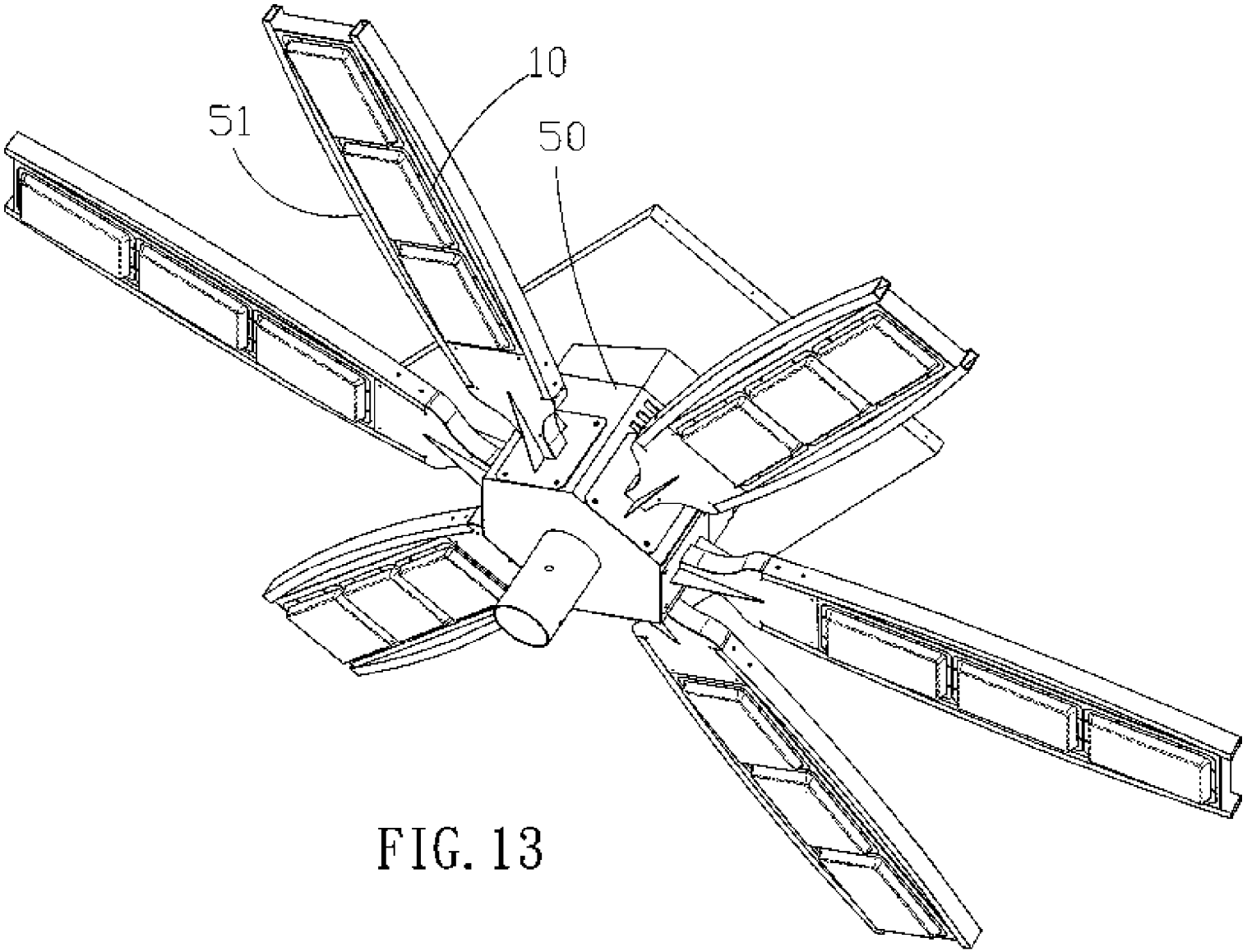
FIG. 13 is an assembled bottom view of the movable light bar assembly and the lamp body shown in FIG. 12.
Figure 14:
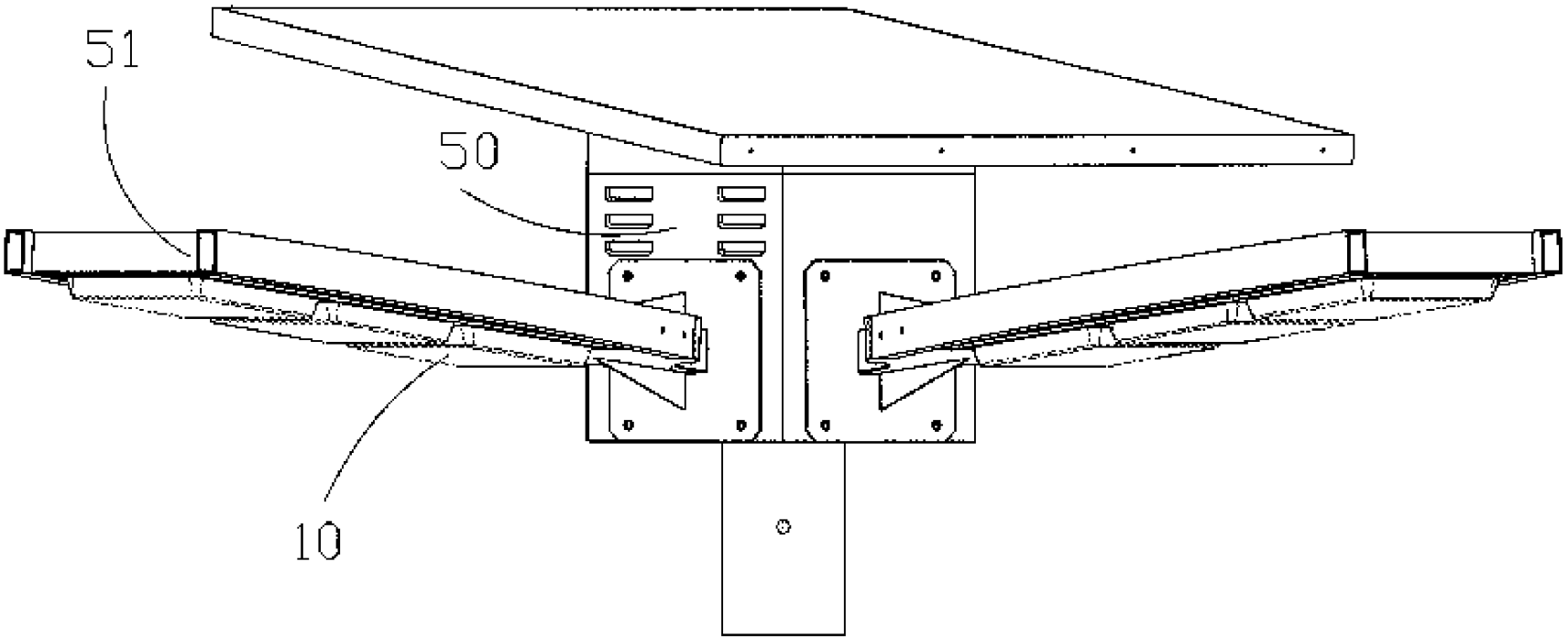
FIG. 14 is an assembled side view of the movable light bar assembly and the lamp body shown in FIG. 12.

Also, in certain embodiments as shown in FIGS. 12 to 14, the light bar assembly of the present invention further includes a lamp support body 50. The lamp support body 50 has at least one arm-like lamp support frame 51 that, in assembly, resembles a petal of a palmate flower (e.g. see FIG. 13). The primary frame 10 is positioned on a bottom side of the lamp support frame 51, as shown in FIGS. 12 to 14, or on a top or lateral side of the lamp support frame 51. The lamp support body 50 can be coupled with a lamppost so as to form a street lamp. In addition, the primary frame 10 may be positioned at the lamp support frame 51 in different ways, such as via the aforementioned fixing base 30 or a supporting seat 60 described further below. Moreover, the lamp support body 50 may be additionally provided with a solar module.

Figure 15:
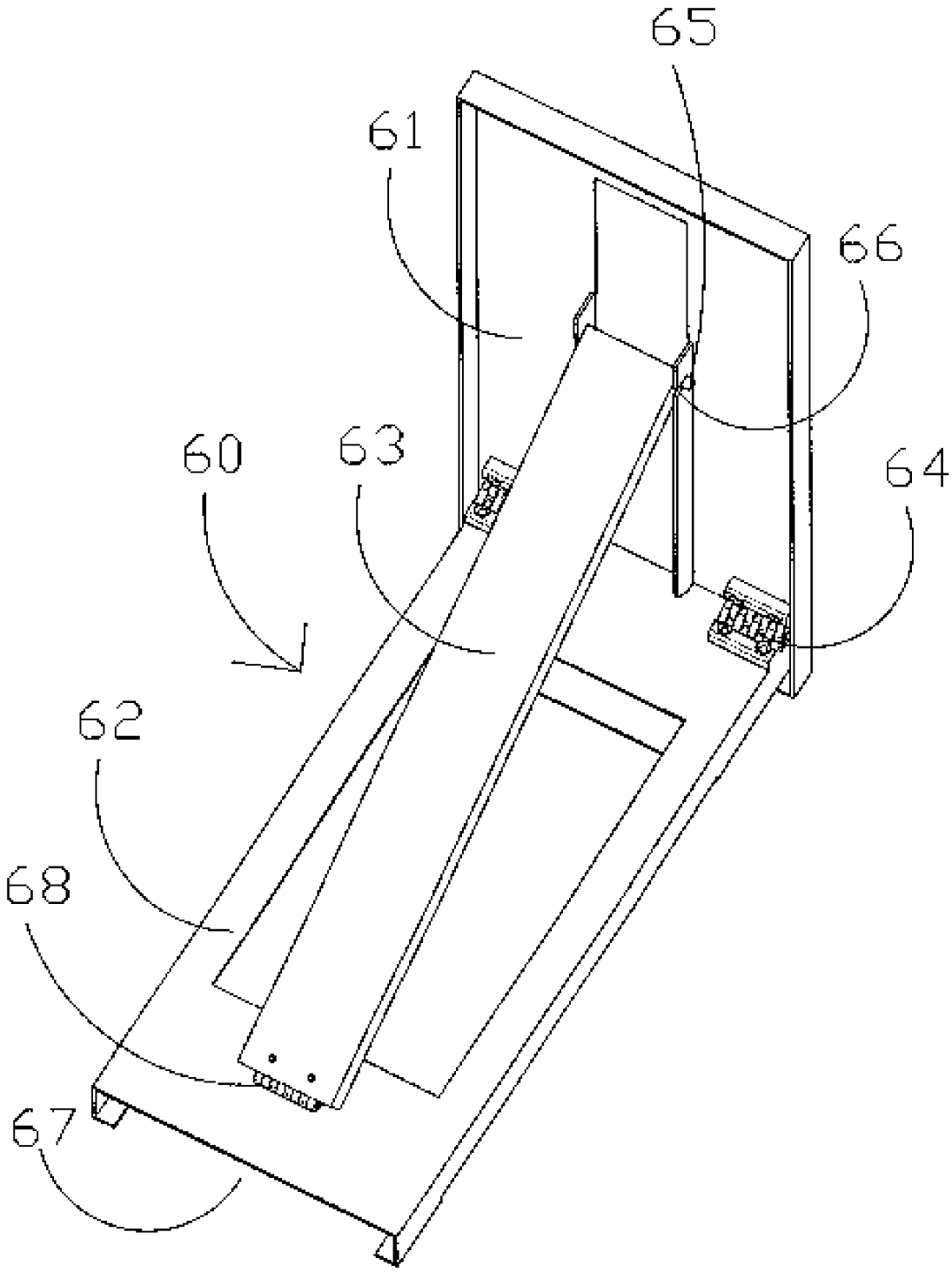
FIG. 15 is a perspective view of a supporting seat according to the present invention, wherein the supporting seal is tilted backward by 90 degrees.
Figure 16:
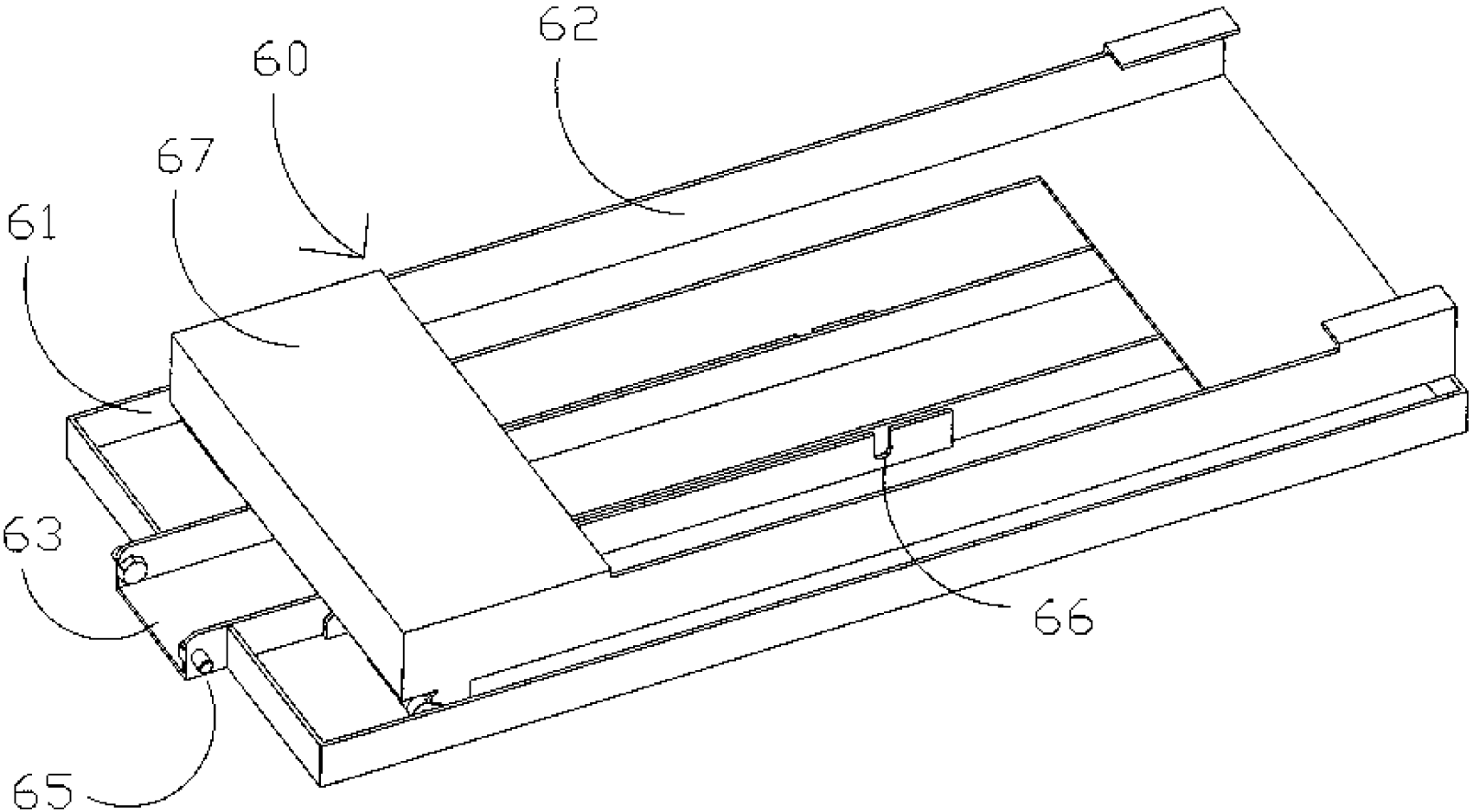
FIG. 16 is a perspective view of the supporting seat according to the present invention in a collapsed state.
Figure 17:
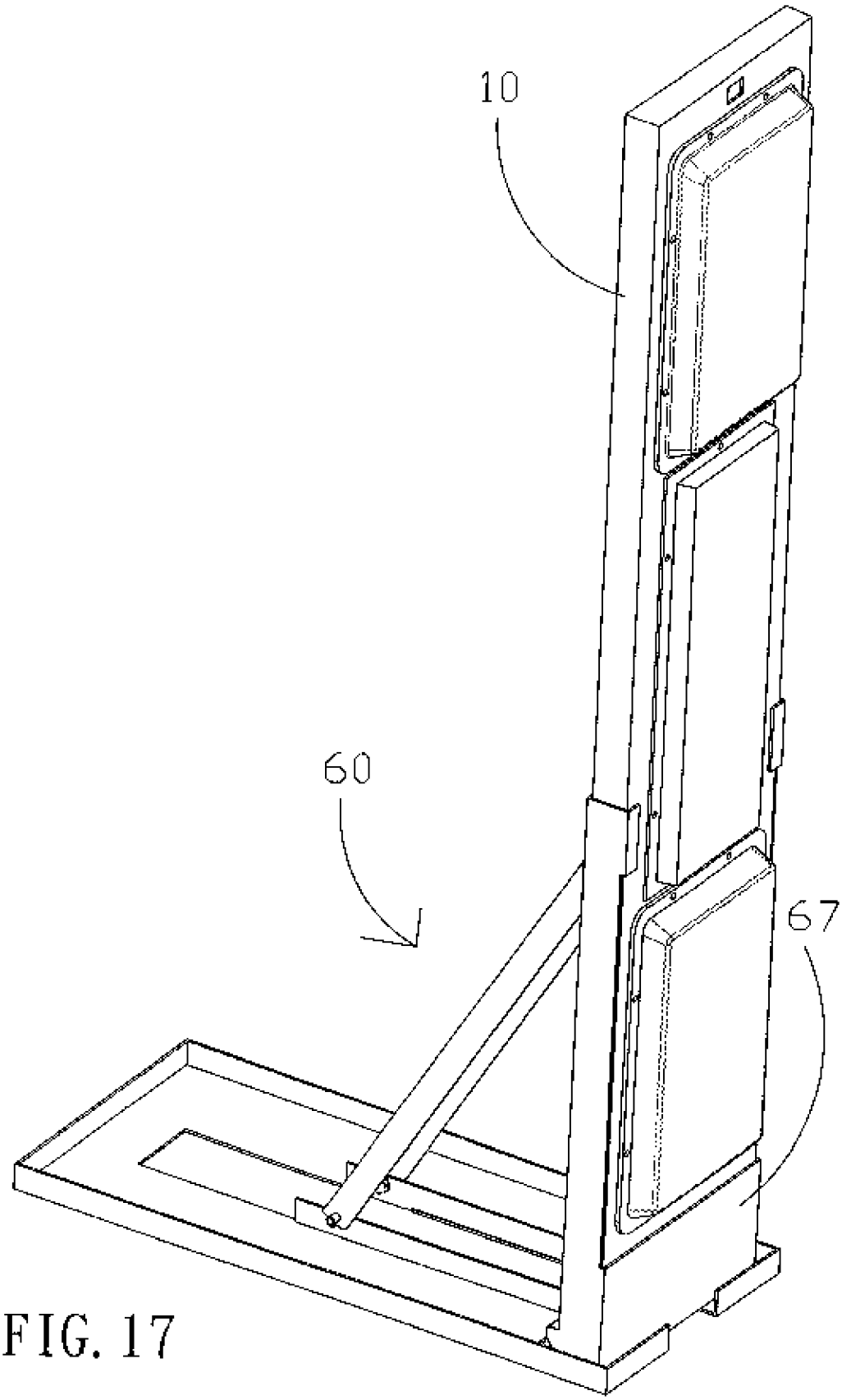
FIG. 17 is an assembled perspective view of the movable light bar assembly and the supporting seat according to the present invention.

Thus, the primary frame 10 and the various components coupled therewith form a single unit. It should be noted that while there are two lighting elements 12 shown in FIG. 1, it is adequate to have only one of the two lighting elements 12. The at least one lighting element 12 is oriented in such a way that a longitudinal axis thereof is parallel to the longitudinal axis of the primary frame 10, as shown in FIGS. 1 through 5, or parallel to a transverse axis of the primary frame 10, as shown in FIGS. 6 and 8. In addition, the at least one lighting element 12 arranged side by side, as shown in FIG. 9, or spaced apart from each other, as shown in FIG. 1, depending on practical needs. Besides, the primary frame 10 is peripherally provided with an output interface (not shown), such as a power supply socket, for enabling output from the battery element 11. Further, the primary frame 10 is peripherally provided with an input interface (not shown), such as a power plug, for charging the battery element 11. Referring to FIG. 15, the light bar assembly of the present invention further includes a supporting seat 60 which has a bottom panel 61, a side panel 62, and a supporting arm 63. The side panel 62 has a lower end coupled with an end of the bottom panel 61 by a pair of hinges 64, thus making the supporting seat 60 collapsible. The side panel 62 further has a rear side pivotally coupled with an end of the supporting arm 63 by another hinge 68. The supporting arm 63 has an opposite end bilaterally provided with positioning pins 65 to be engaged in a pair of positioning holes 66 of the bottom panel 61, respectively. (There may be several pairs of positioning holes 66 arranged in a row such that the position of the supporting arm 63 and consequently the position of the side panel 62 are adjustable.) A receiving groove 67 is formed at a lower part of a front end of the side panel 62 for receiving the light bar assembly including the primary frame 10 such that the light bar assembly is supported in an upright or inclined position, as shown in FIG. 17. FIG. 16 shows the supporting seat 60 in a collapsed state.

In conclusion, the present invention provides a portable bar-shaped light assembly having a power supply unit. The light bar assembly is suitable for use as an indoor lighting device for homes and buildings. Basically, the light bar assembly only has to be charged during daytime to supply the electricity necessary for nighttime operation. The light bar assembly is in the form of an enlarged keyless cell phone to achieve portability. To be exact, the light bar assembly is a large floor lamp that not only depends less on mains electricity than its counterparts in the prior art, but is also capable of charging certain electronic products, such as cell phones. However, if sunlight is unavailable for a long time, the light bar assembly can still be charged by mains electricity. Thus, the present invention helps reduce the dependence on energy derived from fossil fuel and contributes to the reduction of carbon dioxide. It is understood that the present invention may have further and more flexible applications in street lamps, as shown in FIGS. 13 and 14. In short, the present invention is convenient in use, highly versatile in the combination of components, and therefore totally different from the prior art devices.

The present invention is described herein by reference to the preferred embodiment and the accompanying drawings. However, the embodiment is not intended to limit the scope of the present invention, which is defined only by the appended claims. Therefore, all embodiments and structures derived from the concept of the appended claims should be considered within the scope of the present invention.

What is claimed is:

1. A movable light bar assembly, comprising:

a primary frame having a lateral side, an opposite lateral side, and four peripheral edges;

at one handle fastened on one of the four peripheral edges of the primary frame and fastened to the primary frame by a thumb screw such that the at least one handle is rotatable about said thumb screw and is positionable at an angle relative to the lateral side of the primary frame, said handle when rotated to be positioned at an angle relative to the primary frame, serves to support the primary frame;

at least a lighting element coupled to the primary frame via the opposite lateral side thereof, provided internally with at least a light-emitting body, and fixed in position to the primary frame by a lamp cover;

a battery element coupled to the primary frame via the opposite lateral side thereof and fixed in position to the primary frame by a battery cover;

a secondary frame coupled to the primary frame via the lateral side thereof; a plurality of solar chips provided on a surface of the secondary frame; and a photoelectric transducer provided inside the secondary frame;

wherein the photoelectric transducer, the battery element, and the at least a lighting element are electrically connected.

2. The movable light bar assembly of claim 1, further comprising a fixing base having a top end formed with a slot, wherein the at least one handle of the primary frame is insertable in the slot of the fixing base.

3. The movable light bar assembly of claim 1, further comprising at least two handles, each provided on one of at least two peripheral edges of the primary frame; and a hanging cord with two ends, each end connected to one of the two handles, respectively; whereby the primary frame may be suspended by the hanging cord.

4. The movable light bar assembly of claim 1, further comprising a lamp support body having at least one arm-like lamp support frame that, in assembly, resembles a petal of a palmate flower, wherein the primary frame is positioned at a side of the lamp support frame: whereby the lamp support body and the at least one arm-like lamp support frame provide support for the primary frame.

5. The movable light bar assembly of claim 1, wherein the at least a light-emitting body in each said lighting element is a light-emitting diode, a fluorescent tube, or a light bulb.

6. The movable light bar assembly of claim 1, wherein the primary frame is peripherally provided with an output interface for output from the battery element.

7. The movable light bar assembly of claim 1, wherein the primary frame is peripherally provided with an input interface for charging the battery element.

8. The movable light bar assembly of claim 1, further comprising a supporting seat having a bottom panel, a side panel, and a supporting arm, the side panel having a lower end coupled with an end of the bottom panel by a hinge so as for the supporting seat to be collapsible, the side panel having a rear side pivotally coupled with the supporting arm by another hinge, the supporting arm having an opposite end bilaterally provided with positioning pins, the bottom panel being provided with at least a pair of positioning holes for engaging with the positioning pins, and the side panel having a front end formed with a receiving groove for receiving the primary frame.

* * * * *